US011773722B2

(12) United States Patent
Batt

(10) Patent No.: US 11,773,722 B2
(45) Date of Patent: Oct. 3, 2023

(54) METHOD OF ASSEMBLING AND DISASSEMBLING A GAS TURBINE ENGINE MODULE AND AN ASSEMBLY THEREFOR

(71) Applicant: Siemens Energy Global GmbH & Co. KG, Bayern (DE)

(72) Inventor: Stephen Batt, Lincoln (GB)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/778,155

(22) PCT Filed: Nov. 27, 2020

(86) PCT No.: PCT/EP2020/083671
§ 371 (c)(1),
(2) Date: May 19, 2022

(87) PCT Pub. No.: WO2021/105385
PCT Pub. Date: Jun. 3, 2021

(65) Prior Publication Data

US 2023/0022776 A1 Jan. 26, 2023

(30) Foreign Application Priority Data

Nov. 29, 2019 (GB) ..... 1917397

(51) Int. Cl.
*F01D 25/28* (2006.01)
*F01D 5/06* (2006.01)

(52) U.S. Cl.
CPC ..... *F01D 5/06* (2013.01); *F01D 25/285* (2013.01); *F05D 2220/32* (2013.01); *F05D 2230/70* (2013.01); *F05D 2240/24* (2013.01)

(58) Field of Classification Search
CPC . F01D 5/06; F01D 5/066; F01D 5/026; F01D 25/285; F02C 7/20; F05D 2220/32;
(Continued)

(56) References Cited

U.S. PATENT DOCUMENTS 2,821,418 A 1/1958 Franz
3,749,516 A 7/1973 Samurin
(Continued)

FOREIGN PATENT DOCUMENTS

CN 102877891 A 1/2013
CN 103161578 A 6/2013
(Continued)

OTHER PUBLICATIONS

International search report and written opinion dated Feb. 15, 2021 for corresponding PCT/EP2020/083671.
(Continued)

*Primary Examiner* — David E Sosnowski
*Assistant Examiner* — Theodore C Ribadeneyra
(74) *Attorney, Agent, or Firm* — WOLTER VAN DYKE DAVIS, PLLC

(57) ABSTRACT

A method of disassembling a rotor module of a gas turbine engine. The gas turbine engine having a rotor output shaft. The rotor module having a centre-bolt, a sleeve, at least one rotor stage, at least one stator stage, a casing and an axis. The method having the steps: attaching a fixture to the at least one rotor stage, attaching the fixture to the casing, detaching the centre-bolt from the at least one rotor stage, detaching the sleeve from the output shaft, attaching the fixture to the sleeve, and removing the rotor module and fixture from the rotor output shaft. There is also presented a method of assembling the rotor module to the gas turbine engine and the apparatus used for disassembly and assembly.

12 Claims, 5 Drawing Sheets

(58) Field of Classification Search
CPC ..... F05D 2230/70; F05D 2240/24; F05D 2230/60
See application file for complete search history.

(56) References Cited

U.S. PATENT DOCUMENTS

| | | | | |
|---|---|---|---|---|
| 3,842,595 | A | 10/1974 | Smith | |
| 3,964,342 | A * | 6/1976 | Beam, Jr. | F01D 5/027 416/500 |
| 4,059,972 | A * | 11/1977 | Beam, Jr. | F01D 5/027 464/180 |
| 4,455,887 | A * | 6/1984 | Lissajoux | F01D 5/027 464/180 |
| 4,586,225 | A | 5/1986 | Bouiller et al. | |
| 5,267,397 | A | 12/1993 | Wilcox | |
| 8,100,666 | B2 * | 1/2012 | Makuszewski | F01D 25/16 29/889.1 |
| 10,190,655 | B2 * | 1/2019 | Luinaud | F01D 25/285 |
| 11,629,596 | B1 * | 4/2023 | Paolucci | F01D 5/06 416/216 |
| 2010/0143149 | A1 | 6/2010 | Benkler | |
| 2012/0151735 | A1 | 6/2012 | Thomas | |
| 2015/0082633 | A1 | 3/2015 | Tailpied | |
| 2016/0010504 | A1 | 1/2016 | Lanni et al. | |
| 2016/0102556 | A1 | 4/2016 | Twell | |
| 2016/0195110 | A1 | 7/2016 | Kolk | |
| 2019/0003381 | A1 | 1/2019 | Kim | |
| 2019/0390605 | A1 * | 12/2019 | Bolgar | F04D 29/321 |
| 2020/0001562 | A1 | 1/2020 | Burkner | |
| 2020/0165935 | A1 * | 5/2020 | Hashimoto | F01D 5/066 |
| 2021/0222580 | A1 * | 7/2021 | Pratt | F01D 5/066 |

FOREIGN PATENT DOCUMENTS

| | | | |
|---|---|---|---|
| CN | 104379881 | A | 2/2015 |
| CN | 105308265 | A | 2/2016 |
| CN | 105392963 | A | 3/2016 |
| CN | 110100076 | A | 8/2019 |
| EP | 3447244 | A1 | 2/2019 |
| JP | S61252803 | A | 11/1986 |
| JP | H0610701 | A | 1/1994 |

OTHER PUBLICATIONS

Zhang; "Technology of Final Assembly Process for V94. 3A Gas Turbine", V94.3A Technological characteristics of the final assembly of large-scale heavy-duty gas turbines; Shanghai Electric Power Generation Equipment Co. Ltd. Shanghai Turbine Plant Shanghai 200240 China; CLC No. TK266; Document ID: A; Article ID: 1672-5549 (2008) 04-0295-03; English abstract on p. 1.

Wu; "Key Technologies in the Mounting of PG 9351 FA Gas Turbine"; PG9351FA; Key technologies in the installation process of large-scale gas turbines; Jiangsu Electric Power Construction First Engineering Company, Nanjing 210028, Jiangsu Province; CLC No. TM611.24; English abstract on p. 3.

* cited by examiner

METHOD OF ASSEMBLING AND DISASSEMBLING A GAS TURBINE ENGINE MODULE AND AN ASSEMBLY THEREFOR

CROSS REFERENCE TO RELATED APPLICATIONS

This application is the US National Stage of International Application No. PCT/EP2020/083671 filed 27 Nov. 2020, and claims the benefit thereof. The International Application claims the benefit of United Kingdom Application No. GB 1917397.0 filed 29 Nov. 2019. All of the applications are incorporated by reference herein in their entirety.

FIELD OF INVENTION

The present invention relates to a method of assembling and disassembling a gas turbine engine and particularly but not exclusively a turbine or compressor module of a gas turbine engine. The present invention further relates to an assembly of a turbine module and a fixture.

BACKGROUND OF INVENTION

The turbine section of a gas turbine engine comprises alternating stator and rotor stages and may be assembled to and disassembled from a rotor shaft either sequentially or by modular build assembly methods. The sequential assembly method is where a first stator stage is assembled to the rotor shaft followed by a first rotor stage, then a second stator stage and so on. The modular assembly method is where the first stator stage, the first rotor stage, the second stator stage and second rotor stage etcetera are pre-assembled as a turbine module using a frame to maintain the relative positioning of the rotor stages and stator stages. The turbine module is then assembled to the rotor shaft and other supporting structure of the gas turbine. The modular assembly method enables simpler servicing in the event of a turbine or compressor section replacement and a reduced downtime for the customer.

FIGS. 1 and 2 show a conventional turbine module 1 having a rotor assembly 2 that employs a multi-bolt arrangement 3. The multi-bolt arrangement 3 holds the turbine rotors 4, 5 together both as part of the turbine module 1 when disassembled from the gas turbine engine and as a turbine section 4, 5 during engine operation. The multi-bolt arrangement 3 comprises a number of bolts 6 that pass through and connect together the two turbine discs 7, 8. A frame 9 is then bolted to the turbine module 1 for securing and handling purposes.

However, for a gas turbine engine having a centre-bolt arrangement, as will be described with reference to the present invention, for securing the turbine section to the rotor shaft the turbine section must be assembled sequentially. In other words, each rotor stage and each stator stage must be assembled and disassembled separately and sequentially.

SUMMARY OF INVENTION

Thus, an object of the presently disclosed method of assembly and disassembly of a gas turbine engine compressor or turbine module and the herein disclosed apparatus for carrying out the method is to provide a simpler and quicker method of assembling and disassembling a compressor or turbine module for new build and/or for servicing purposes. Another object of the presently disclosed method of assembling and disassembling and apparatus is to provide improved handling of the compressor or turbine module.

The above objects are achieved by a method of disassembling a rotor module from a gas turbine engine, the gas turbine engine comprises a rotor output shaft and the rotor module. The rotor module comprises a centre-bolt, a sleeve, at least one rotor stage, at least one stator stage, a casing and an axis. The method comprises the steps attaching a fixture to the at least one rotor stage, attaching the fixture to the casing, detaching the centre-bolt from the at least one rotor stage, detaching the sleeve from the output shaft, attaching the fixture to the sleeve and removing the rotor module and fixture from the rotor output shaft.

In another aspect of the present disclosure, the above objects are achieved by a method of assembling a rotor module to a gas turbine engine. The gas turbine engine comprises a rotor output shaft and the rotor module. The rotor module comprises a centre-bolt, a sleeve, at least one rotor stage, at least one stator stage, a casing and an axis. The method comprises the steps placing the rotor module on to the rotor output shaft, detaching a fixture from the sleeve, attaching the sleeve to the output shaft, attaching the centre-bolt to the at least one rotor stage, detaching the fixture from the casing and detaching the fixture from the at least one rotor stage.

The methods may comprise the step translating the sleeve in an axial direction relative to the at least one rotor stage.

In the method of assembling, the sleeve may comprise a radially extending land that, as a consequence of the step of attaching the fixture to the sleeve a compressive force is provided across the at least one rotor stage between the radially extending land and the fixture.

In the method of assembling, the sleeve may comprise a radially extending land that, as a consequence of the step of detaching the fixture from the sleeve releases a compressive force across the at least one rotor stage between the radially extending land and the fixture respectively.

In the method of disassembling, the method may comprise the step detaching the centre-bolt from the gas turbine engine at a rearward end of the centre-bolt and the step of removing the rotor module and fixture from the rotor output shaft also comprises removing the centre-bolt.

In another aspect of the present disclosure, the above objects are achieved by a rotor module for a gas turbine engine and a fixture. The rotor module comprises a centre-bolt, a sleeve, at least one stator stage, at least one rotor stage, a casing, an axis and a fixture. The sleeve surrounds at least a part of the centre-bolt, the at least one stator stage and the at least one rotor stage surround the sleeve, the casing surrounds the at least one stator stage and the at least one rotor stage. Wherein the fixture is attached to and secures together the casing, the at least one rotor and a forward end of the sleeve, wherein the sleeve comprises a radially extending land that engages an opposing side of the at least one rotor stage thereby the fixture and sleeve providing a compressive force across the at least one rotor stage.

The fixture may comprise an inner part, a mid-section and an outer part. The outer part is attached to the casing, the mid-section is attached to the at least one rotor stage and the inner part is attached to the sleeve.

The mid-section may be generally frustoconical or a truncated cone shape.

The fixture may be annular. Alternatively, the fixture may comprise a number of radially extending arms.

The fixture may be secured to the sleeve via a threaded ring which engages a threaded section on a forward end of the sleeve.

The at least one rotor stage may be two rotor stages. The at least one stator stage may be two stator stages. The downstream order may be a first stator stage, a first rotor stage, a second stator stage and a second rotor stage.

The at least one rotor stage may be three rotor stages. The at least one stator stage may be three stator stages. The downstream order may be a first stator stage, a first rotor stage, a second stator stage, a second rotor stage, a third stator stage and a third rotor stage.

The rotor module may be of a turbine section or a compressor section of the gas turbine engine.

BRIEF DESCRIPTION OF THE DRAWINGS

The above-mentioned attributes and other features and advantages of the present disclosure and the manner of attaining them will become more apparent and the present disclosure itself will be better understood by reference to the following description of embodiments of the present disclosure taken in conjunction with the accompanying drawings, wherein.

DETAILED DESCRIPTION OF INVENTION

Figure 1:
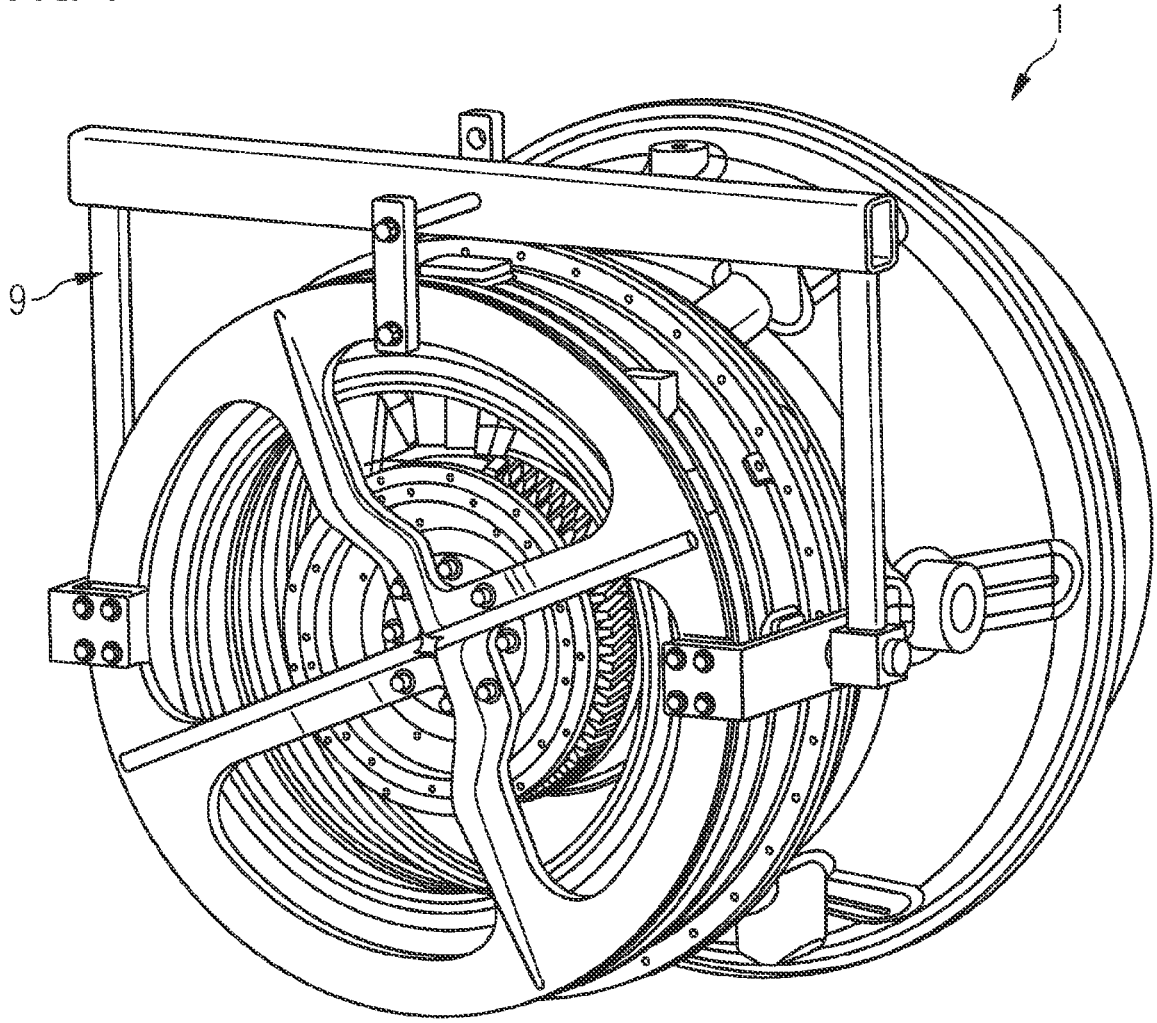
FIG. 1 is a view of a conventional modular turbine assembly and handling frame.
Figure 2:
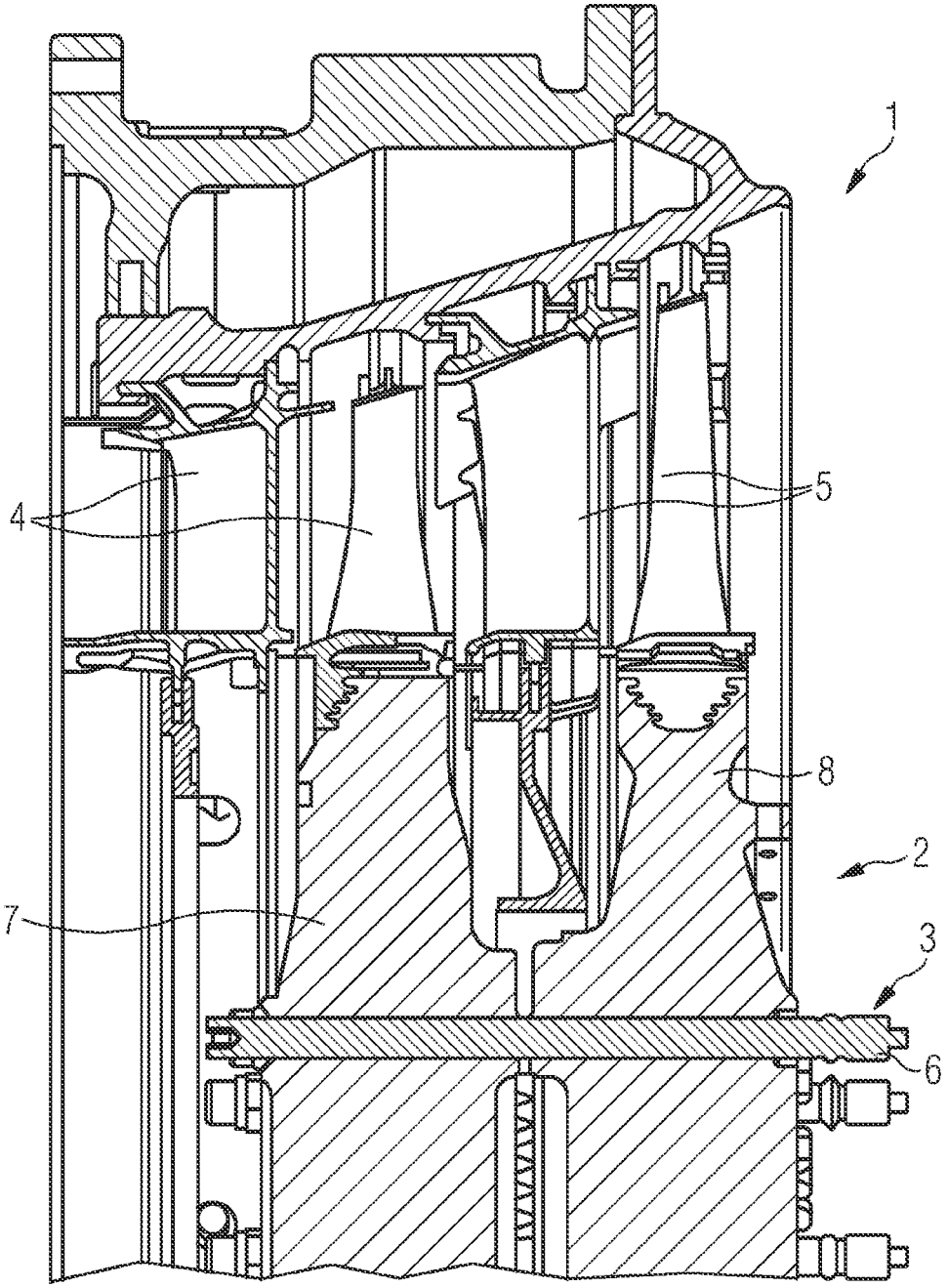
FIG. 2 is a section through the conventional modular turbine assembly of FIG. 1 and showing a turbine section having a multi-bolt arrangement.
Figure 3:
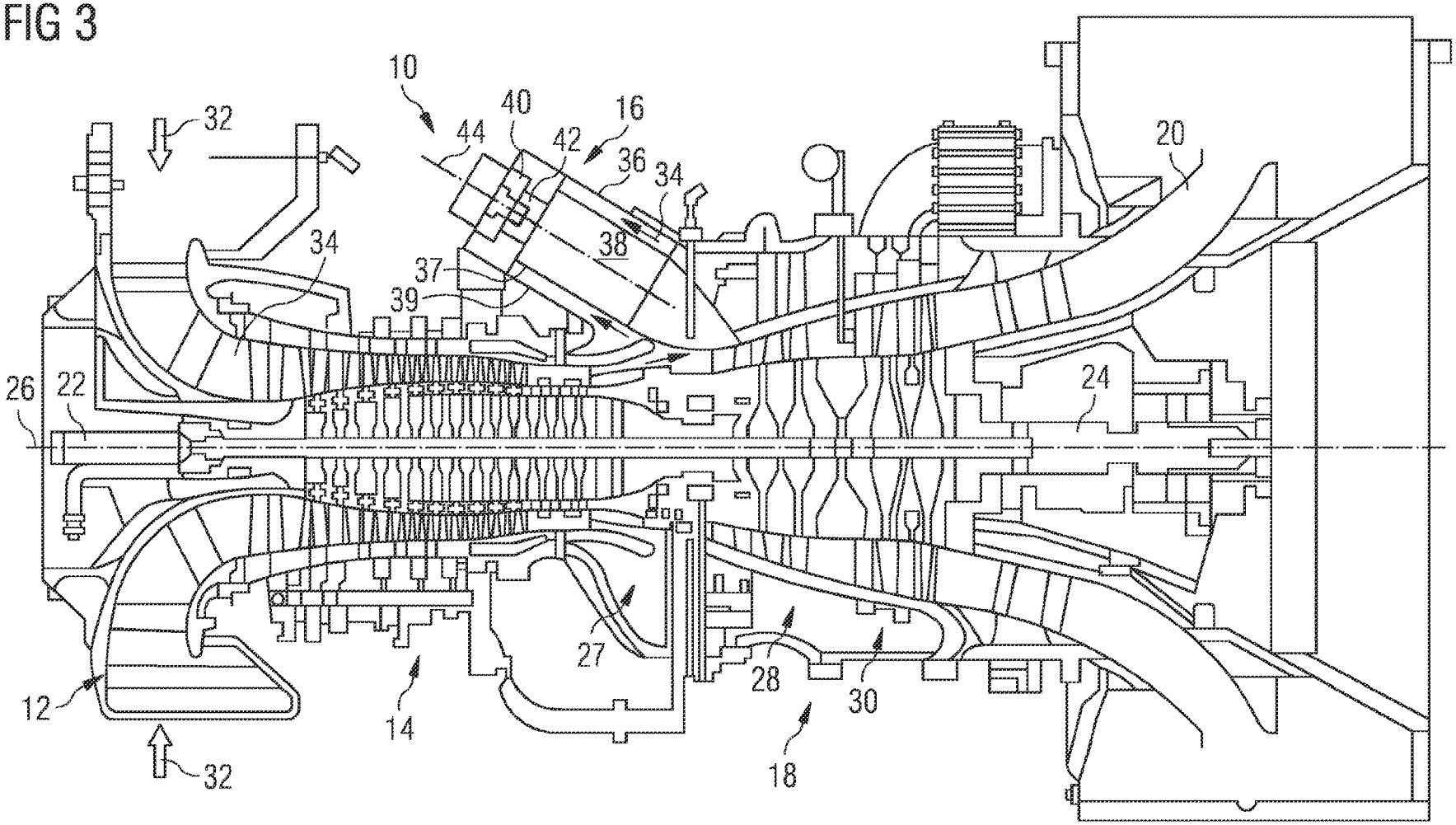
FIG. 3 shows part of a turbine engine in a sectional view and to which the present method of assembling and disassembling a turbine module of the gas turbine engine is applicable.

FIG. 3 is a schematic illustration of a general arrangement of a turbine engine 10 having an inlet 12, a compressor 14, a combustor system 16, a turbine system 18, an exhaust duct 20 and a twin-shaft arrangement 22, 24. The turbine engine 10 is generally arranged about an axis 26 which for rotating components is their rotational axis. The shafts of the twin-shaft arrangement 22, 24 may have the same or opposite directions of rotation. The combustor system 16 comprises an annular array of combustor units 36, only one of which is shown. In one example, there are six combustor units evenly spaced about the engine 10. The turbine system 18 includes a high-pressure turbine 28 drivingly connected to the compressor 14 by a first shaft 22 of the twin-shaft arrangement. The turbine system 18 also includes a low-pressure turbine 30 drivingly connected to a load (not shown) via the second or output shaft 24 of the twin-shaft arrangement. The load may be a compressor or a generator for example.

The terms radial, circumferential and axial are with respect to the engine's rotational axis 26 or as otherwise stated. The terms upstream and downstream are with respect to the general direction of gas flow through the engine and as seen in FIG. 3 is generally from left to right.

The compressor 14 comprises an axial series of stator vanes and rotor blades mounted in a conventional manner. The stator or compressor vanes may be fixed or have variable geometry to improve the airflow onto the downstream rotor or compressor blades. Each turbine 28, 30 comprises an axial series of stator vanes and rotor blades. The stator vanes can be mounted to a radially outer casing or a radially inner drum. The rotor blades are mounted via rotor discs arranged and operating in a conventional manner. A rotor assembly comprises an annular array of rotor blades or blades and the rotor disc.

Each combustor unit 36 is constructed from two walls, an inner wall 37 and an outer wall 39, between which is defined a generally annular space. At the head of the combustor unit 36 is a swirler 40 which comprises a swirl plate, an annular array of swirler vanes and fuel injection points as will be described in more detail later. The swirler 40 is succeeded by a pre-chamber 42 and then a main combustion chamber 38. These combustor unit 36 components are generally arranged about a combustor central axis 44.

In operation air 32 is drawn into the engine 10 through the inlet 12 and into the compressor 14 where the successive stages of vanes and blades compress the air before delivering the compressed air 34 into the combustor system 16. The compressed air 34 flows between the inner and outer walls 37, 39 and into the swirler 40. The swirler 40 creates highly turbulent air into which the fuel is injected. The air/fuel mixture is delivered into the pre-chamber 42, where mixing continues, and then into the main combustion chamber 38. In the combustion chamber 38 of the combustor system 16 the mixture of compressed air and fuel is ignited and burnt. The resultant hot working gas flow is directed into, expands and drives the high-pressure turbine 28 which in turn drives the compressor 14 via the first shaft 22. After passing through the high-pressure turbine 28, the hot working gas flow is directed into the low-pressure turbine 30 which drives the load via the second shaft 24.

The low-pressure turbine 30 can also be referred to as a power turbine and the second shaft 24 can also be referred to as a power shaft. The load is typically an electrical machine for generating electricity or a mechanical machine such as a pump or a process compressor. Other known loads may be driven via the low-pressure turbine. The fuel may be in gaseous and/or liquid form.

The turbine engine 10 shown and described with reference to FIG. 3 is just one example of a number of engines or turbomachinery in which this invention can be incorporated. Such engines can be gas turbines or steam turbine and include single, double and triple shaft engines applied in marine, industrial and aerospace sectors.

Figure 4:
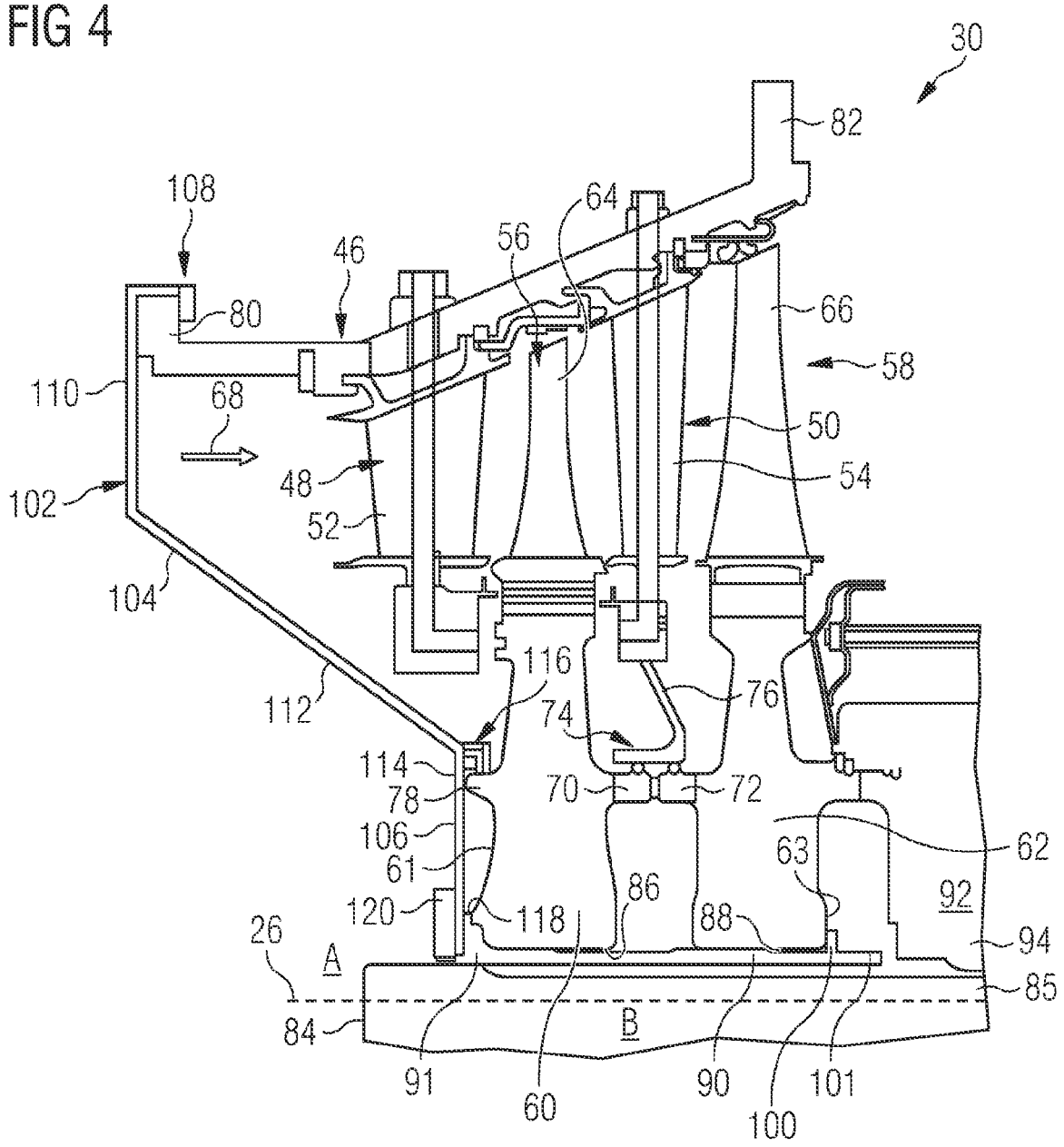
FIG. 4 shows part of a turbine module of the turbine engine in a sectional view and to which the present method of assembling and disassembling a turbine module of the gas turbine engine and associated assembly apparatus is applicable.

FIG. 4 shows part of a turbine section, in this case the power turbine module 30, of the turbine engine 10 and in a sectional view. The turbine module 30 comprises a casing 46 that supports a first stator stage 48 and a second stator stages 50. The first and second stator stages 48, 50 each comprise an annular array of vanes 52, 54, where each vane 52, 54 extends radially inwardly from the casing 46. The turbine module 30 further comprises a first rotor stage 56 and a second rotor stage 58. Each of the first and second rotor stages 56, 58 comprise a disc 60, 62 and an annular array of rotor blades 64, 66 respectively, the rotor blades 64, 66 each extending radially outwardly. Hot working gases are indicated by arrow 68 and which travel in a generally axial direction through and in order the first stator stage 48, the first rotor stage 56, the second stator stage 50 and the second rotor stage 58. The vanes 52, 54 of the first stator stage 48 and second stator stage 50 direct the hot working gases favourably onto their downstream annular arrays of rotor blades 64, 66 of first rotor stage 56 and the second rotor stage 58 respectively and in conventional fashion.

The two rotor discs 60, 62 are drivingly connected to one another via respective annular arms 70, 72 which axially extend from their respective discs 60, 62. The two annular arms 70, 72 form a seal 74 with a diaphragm 76 that radially inwardly extends from the second array of stator vanes 50. A seal arm 78 extends axially forward from the first rotor disc 60 and which seals with a static member (not shown) of the gas turbine 10.

The casing 46 is rigidly attached to forward and rearward engine casing structures (not shown) via forward and rearward flanges 80, 82 respectively and in conventional manner.

The rotor module 30 further comprises a centre-bolt or tie-shaft 84 and a sleeve 90. Each rotor disc 60, 62 has a central bore 86, 88 through which the centre bolt 84 extends in an axial direction. The sleeve 90 surrounds at least a part of the centre-bolt 84 and is located between the centre-bolt 84 and the central bores 86, 88 of the discs 60, 62. The rotor discs 60, 62, sleeve 90 and centre-bolt 84 are concentrically arranged about the engine axis 26 when in at least the assembled state in the gas turbine engine 10. Annular gaps or a clearance exist between the sleeve 90 and the bores 86, 88 of the discs 60, 62 such that the sleeve 90 and the discs 60, 62 do not touch each other.

Figure 6:
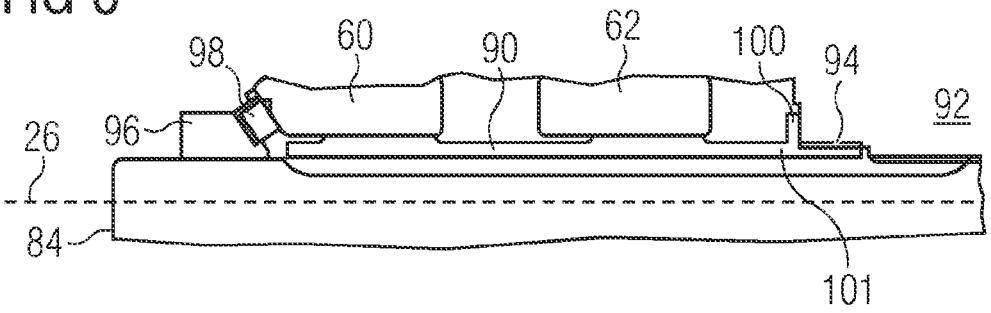
FIG. 6 is an enlarged view on B in FIG. 4 the hub region of the turbine section and showing a centre-bolt, the sleeve, a retention nut and collar in an assembled state.
Figure 7:
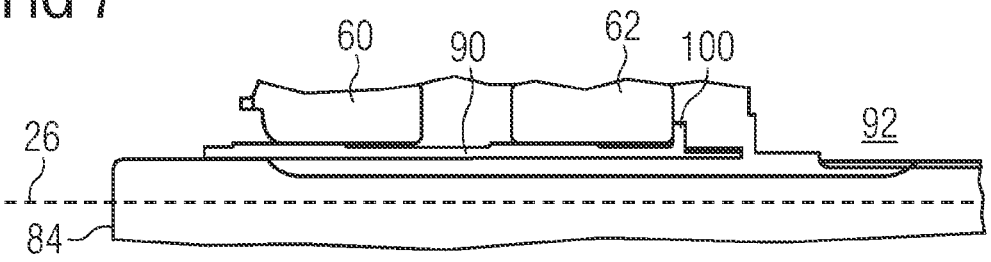
FIG. 7 is an enlarged view on B in FIG. 4 the hub region of the turbine section and showing the centre-bolt, the sleeve, the retention nut and collar disassembled from the centre-bolt and the sleeve unscrewed from and slid along the centre-bolt.

When assembled in the gas turbine 10, the centre-bolt 84 attaches via an attachment 94 to a rotor output shaft 92 of the gas turbine 10. The attachment 94 is a spline or other threaded engagement means with corresponding features on the centre-bolt 84 and rotor output shaft 92 as is known in the art. The attachment 94 is rearward or downstream of the second rotor disc 62. As can be seen in FIG. 6, a nut 96 is screwed onto the upstream end of the centre-bolt 84 and traps a collar 98 against the upstream or forward side of the first rotor disc 60. The nut 96 is screwed against the collar 98 and therefore rotor disc 60 to create a compressive force across the two rotor stages 56, 58 and holds the two rotor stages 56, 58 to the output shaft 92.

Thus, in the fully assembled state the rotor module 30 is attached and secured in the gas turbine 10 via the centre-bolt 84 and forward and rearward flanges of the casing 46 to associated architecture as described above.

Referring again to FIG. 6 which is an enlarged view on the hub region of the turbine module 30 and showing the centre-bolt 84, the sleeve 90, the retention nut 96 and collar 98 in an assembled state where the turbine engine 10 can operate normally. The sleeve 90 comprises a radially extending land 100 near the downstream or rearward end 101 of the sleeve 90. The land 100 is annular and of a constant size or diameter but may be crenelated, part-annular or other suitable shape for engaging the rotor disc 62 and/or the rotor output shaft 92. In this assembled state the land 100 is contacting the upstream surface of the rotor output shaft 92 and acts to locate or limit the turbine module relative to the rotor output shaft 92.

Referring back to FIG. 4 which shows the turbine module 30 in a partially disassembled state and with a fixture 102 attached to the casing 46, the rotor disc 60 and the sleeve 90 at the forward or upstream end of the turbine module 30. The fixture 102 has a generally annular form although the fixture 102 may comprise a number of arms 104 that extend radially from a central portion 106.

In whichever form, the fixture 102 comprises, in radially outward sequence, a radially inner part 114, a mid-section 112 and a radially outer part 110. The radially outer part 110 of the fixture 102 is parallel and, when secured to the turbine module 30, is in contact with the forward-facing surface of the flange 80. The fixture 102 comprises a first attachment 108 that attaches to the casing 46 and specifically the flange 80 at the forward or upstream end of the casing 46. The first attachment 108 is in the form of a first clamp 108. The clamp 108 extends from the radially outer most part of the fixture 102 to contact the radially outer surface of the flange 80 and then turns radially inwardly to contact the rearward facing surface of the flange 80. The fixture 102 and clamp 108 securely hold the flange 80 and therefore casing 46 in at least the axial and the radial directions against relative movement therebetween. Alternative to the clamp 108, the flange 80 and fixture 102 (via the radially outer part 110) may be bolted together by an annular array of bolts (and nuts) in a conventional fashion.

The mid-section 112 is angled upstream or rearwardly when traversing from the radially outer part 110 to the radially inner part 114, such that the radially inner part 114 is further rearward or downstream than the radially outer part 110. Thus, the mid-section 112, or at least a part of the mid-section 112, is frustoconical or truncated cone shaped and intrinsically this shape makes the fixture 102 very stiff. The radially inner part 114 is attached to the first rotor stage 56 and specifically the first rotor disc 60. The fixture 102, at the radially inner part 114, comprises a second attachment 116 which is secured to the seal arm 78 via a second clamp 116. The radially inner part 114 contacts the forward or upstream surface of the seal arm 78 and the second clamp 116 extends axially rearward from the fixture 102 without contacting the radially outer surface of the seal arm 78, and then, extends radially inwardly to contact the rearward or downstream surface of the seal arm 78. Thus, the seal arm 78 is clamped by the second clamp's 116 opposing axial surfaces such that relative axial movement between the fixture 102 and the first rotor disc 60 is prevented.

The first and second clamps 108, 116 may be of a hook-clamp type as is well known in the art.

The fixture 102 engages the upstream or forward side 61 of the first rotor stage 56 and the land 100 engages the downstream or rearward side 63 of the second rotor stage 58. Where there is only one rotor stage or more than two rotor stages the upstream or forward side 61 is the furthest upstream or forward side of any of the rotor stages and the downstream or rearward side 63 is the furthest downstream or rearward side of any of the rotor stages. When the fixture 102 is fully attached and secured to the turbine module 30 the fixture and the land 100 engage respective forward and rearward sides of the at least one rotor stage 56, 58 and provide a compressive force across the two sides 61, 63. Even where there is just one rotor stage 56, the compressive force across the rotor stage effectively holds or clamps the rotor stage(s) in position relative to the (at least one) stator stage(s) 48 and the casing 46.

Figure 5:
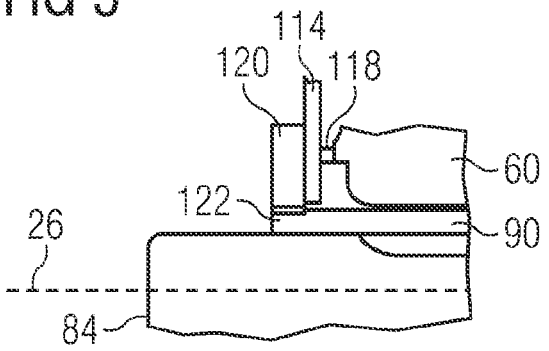
FIG. 5 is an enlarged view on A in FIG. 4 and shows details of the assembly apparatus including part of a fixture, a sleeve and a threaded nut.

Referring now to FIG. 5 which is an enlarged view on A in FIG. 4. The radially inner part 114 of the fixture 102 is secured to the sleeve 90 via a threaded ring 120 which engages a threaded section 122 on the upstream or forward end 91 of the sleeve 90. The ring 120 forces the radially inner part 114 in an axial direction and against a projection 118 which extends in an axial direction from the forward or upstream side 61 of the first disc 60. As the ring 120 is screwed onto the sleeve 90, the sleeve 90 is drawn forwardly or in an upstream direction and the land 100 engages or contacts the second disc 62 on its downstream side 63 and a compressive force is applied across the turbine rotor discs 60, 62. This compressive force holds the two rotor stages 56, 58 together and to the fixture 102.

Thus, when the turbine module 30 is removed from the turbine engine 10, the fixture 102 securely fastens together the two rotor stages 56, 58, the two stator stages 48, 50 the casing 46 and the sleeve 90. The turbine module 30 can now be safely removed from the turbine engine 10 and maintenance can be performed on the turbine engine 10 and/or the turbine module 30 more easily. Thus, in this way the turbine module 30 may be removed and re-assembled to the turbine engine 10 more easily and in one assembly and does not require complete disassembly/assembly of the separate components, such as the turbine rotors and blades from the engine. In this way, a much quicker disassembly and assembly is possible, and which also saves significant costs and manpower as well as reduced engine downtime. The turbine module 30 may further comprise the centre-bolt 84. However, the centre-bolt 84 may be removed on its own and before the turbine module 30 is removed from the engine 10 or removed from turbine module 30 after the turbine module 30 has been removed from the turbine engine 10.

From the above description, the present method of disassembling the rotor module 30 from the gas turbine engine 10 comprising the steps: attaching the fixture 102 to one of the rotor stages 56, 58; attaching the fixture 102 to the casing 46; detaching the centre-bolt 84 from the rotor stages 56, 58; detaching the sleeve 90 from the output shaft 92 of the gas turbine engine 10; attaching the fixture 102 to the sleeve 90; and, removing the rotor module 30 and fixture 102 from the rotor output shaft 92.

In concert with the above method of disassembling the rotor module 30 there is a method of assembling or reassembling the rotor module 30 comprising the steps: placing the rotor module 30 onto the rotor output shaft 92; detaching the fixture 102 from the sleeve 90; attaching the sleeve 90 to the output shaft 92; attaching the centre-bolt 84 to the rotor stages 56, 58; detaching the fixture 102 to the casing 46; and, detaching the fixture 102 from the rotor stages 56, 58.

When the sleeve 90 is not attached to the output shaft 92, the sleeve 90 can be translated axially relative to the rotor discs 60, 62. Thus, the method of disassembling comprises the step of translating the sleeve 90 in an axial direction relative to the one rotor disc 60, 62 after detaching the sleeve 90 from the output shaft 92 and before attaching the fixture 102 to the sleeve 90. Similarly, method of assembling comprises the step of translating the sleeve 90 in an axial direction relative to the one rotor disc 60, 62 after detaching the fixture 102 from the sleeve 90 and before attaching the sleeve 90 to the output shaft 92 and before attaching. During this step, the land 100 translates between the downstream side 63 of the rotor stage 58 and the upstream surface of the output rotor shaft 92. In particular, when assembling the land 100 translates from being in contact with the downstream side 63 of the rotor stage 58 and being in contact with the upstream surface of the output rotor shaft 92. Similarly, when disassembling the land 100 translates from being in contact with the upstream surface of the output rotor shaft 92 and being in contact with the downstream side 63 of the rotor stage 58.

As a consequence of attaching the fixture 102 to the sleeve 90 a compressive force is provided across the rotor stage or rotor stages 56, 58 by virtue of the radially extending land 100 engaging the rotor disc 62 and the fixture 102 engaging the arm 78 and/or projection 118. Similarly, when assembling the turbine module 30 to the gas turbine 10, detaching the fixture 102 from the sleeve 90 releases the compressive force across the rotor stage or rotor stages 56, 58 and between the radially extending land 100 and the fixture 102 respectively.

The presently described methods of disassembling and assembling the rotor module 30 and the rotor module incorporating the fixture 102 are described with reference to a turbine system 18; however, they are intended to be applicable to the compressor section 14. Although, applicable to the compressor section 14 the fixture 102 would be attached to the compressor module from the downstream or rearward side rather than the upstream or forward side as the case is for the turbine module. Therefore, where applicable the terms upstream, downstream, forward and rearward are reversed.

All the features disclosed in this specification (including any accompanying claims, abstract and drawings), and/or all the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of disassembling a rotor module from a gas turbine engine, the gas turbine engine comprising a rotor output shaft, a centre-bolt, and the rotor module, the rotor module comprising, a sleeve, at least one rotor stage, at least one stator stage, a casing and an axis, the method comprising:

attaching a fixture to the at least one rotor stage, attaching the fixture to the casing, detaching the centre-bolt from the at least one rotor stage, detaching the sleeve from the rotor output shaft, attaching the fixture to the sleeve, removing the rotor module and the fixture from the rotor output shaft, and translating the sleeve in an axial direction relative to the at least one rotor stage.

2. The method of assembling as claimed in claim 1, wherein the sleeve comprises a radially extending land that, as a consequence of attaching the fixture to the sleeve, a compressive force is provided across the at least one rotor stage between the radially extending land and the fixture.

3. The method of disassembling as claimed in claim 1, further comprising:

detaching the centre-bolt from the gas turbine engine at a rearward end of the centre-bolt, and wherein removing the rotor module and the fixture from the rotor output shaft also comprises removing the centre-bolt.

4. A method of assembling a rotor module to a gas turbine engine, the gas turbine engine comprises a rotor output shaft, a centre-bolt, and the rotor module, the rotor module comprises a sleeve, at least one rotor stage, at least one stator stage, a casing and an axis, the method comprising:

placing the rotor module on to the rotor output shaft, detaching a fixture from the sleeve, attaching the sleeve to the rotor output shaft, attaching the centre-bolt to the at least one rotor stage, detaching the fixture from the casing, detaching the fixture from the at least one rotor stage, and translating the sleeve in an axial direction relative to the at least one rotor stage.

5. The method of assembling as claimed in claim 4, wherein the sleeve comprises a radially extending land that, as a consequence of detaching the fixture from the sleeve, releases a compressive force across the at least one rotor stage between the radially extending land and the fixture respectively.

6. A rotor module for a gas turbine engine and a fixture, the rotor module comprising:

a centre-bolt, a sleeve, at least one stator stage, at least one rotor stage, a casing, an axis, wherein the sleeve surrounds at least a part of the centre-bolt, the at least one stator stage and the at least one rotor stage surround the sleeve, the casing surrounds the at least one stator stage and the at least one rotor stage, wherein the fixture is attached to and secures together the casing, the at least one rotor stage and the sleeve, wherein the sleeve comprises a radially extending land that engages an opposing side of the at least one rotor stage to the fixture and thereby the fixture and the sleeve provide a compressive force across the at least one rotor stage, and wherein the fixture is secured to the sleeve via a threaded ring which engages a threaded section on a forward end of the sleeve.

7. The rotor module and the fixture as claimed in claim 6, wherein the fixture comprises an inner part, a mid-section and an outer part, wherein the outer part is attached to the casing, wherein the mid-section is attached to the at least one rotor stage, and wherein the inner part is attached to the sleeve.

8. The rotor module and the fixture as claimed in claim 7, wherein the mid-section is generally frustoconical or a truncated cone shape.

9. The rotor module and the fixture as claimed in claim 6, wherein the fixture is annular.

10. The rotor module and the fixture as claimed in claim 6, wherein the fixture comprises a number of radially extending arms.

11. The rotor module and the fixture as claimed in claim 6, wherein the at least one rotor stage is two rotor stages, wherein the at least one stator stage is two stator stages, and wherein the order is a first stator stage, a first rotor stage, a second stator stage and a second rotor stage.

12. The rotor module and the fixture as claimed in claim 6, wherein the rotor module is of a turbine section or a compressor section of the gas turbine engine.

* * * * *